US008742244B2

(12) United States Patent
Wissmuller

(10) Patent No.: US 8,742,244 B2
(45) Date of Patent: Jun. 3, 2014

(54) ELECTRONIC HI-HAT CYMBAL CONTROLLER

(75) Inventor: Jan Wissmuller, Sarasota, FL (US)

(73) Assignee: Inmusic Brands, Inc., Cumberland, RI (US)

( * ) Notice: Subject to any disclaimer, the term of this patent is extended or adjusted under 35 U.S.C. 154(b) by 0 days.

(21) Appl. No.: 13/561,775

(22) Filed: Jul. 30, 2012

(65) Prior Publication Data

US 2013/0047826 A1 Feb. 28, 2013

Related U.S. Application Data

(60) Provisional application No. 61/529,284, filed on Aug. 31, 2011.

(51) Int. Cl.
*G10H 3/00* (2006.01)

(52) U.S. Cl.
USPC ..... 84/723; 84/730; 84/746

(58) Field of Classification Search
USPC ..... 84/723, 730, 733, 734, 746
See application file for complete search history.

(56) References Cited

U.S. PATENT DOCUMENTS 4,984,498 A * 1/1991 Fishman ..... 84/730
5,748,566 A * 5/1998 Goodson ..... 367/158
6,576,829 B1 * 6/2003 Hart ..... 84/737
6,815,604 B2 * 11/2004 Toda ..... 84/746
7,294,778 B2 * 11/2007 Susami ..... 84/723
7,323,632 B2 * 1/2008 Wachter ..... 84/730
7,459,626 B2 * 12/2008 Yoshino et al. ..... 84/723
7,468,483 B2 * 12/2008 Yoshino ..... 84/723
7,473,834 B2 * 1/2009 Yoshino ..... 84/402
7,560,638 B2 * 7/2009 Susami ..... 84/723
7,655,857 B2 * 2/2010 Yoshino et al. ..... 84/723
7,943,841 B2 * 5/2011 Toda ..... 84/422.3
8,410,348 B1 * 4/2013 Hsieh ..... 84/743
2002/0014810 A1 * 2/2002 Maruyama ..... 310/323.06
2004/0016339 A1 * 1/2004 Yoshino et al. ..... 84/723
2005/0039593 A1 * 2/2005 Wachter ..... 84/730
2005/0145101 A1 * 7/2005 Yoshino ..... 84/723
2005/0145102 A1 * 7/2005 Susami ..... 84/735
2005/0150349 A1 * 7/2005 Susami ..... 84/299
2006/0066181 A1 * 3/2006 Bromfield et al. ..... 310/363
2006/0156910 A1 * 7/2006 Yoshino ..... 84/723
2012/0048099 A1 * 3/2012 Wissmuller ..... 84/723
2012/0118130 A1 * 5/2012 Field ..... 84/730
2013/0047826 A1 * 2/2013 Wissmuller ..... 84/723
2013/0125735 A1 * 5/2013 Mori ..... 84/723

* cited by examiner

*Primary Examiner* — David S. Warren
(74) *Attorney, Agent, or Firm* — Finnegan, Henderson, Farabow, Garrett & Dunner, L.L.P.

(57) ABSTRACT

An electronic hi-hat cymbal controller is disclosed. The controller includes a hi-hat cymbal stand having a pedal and a shaft. The pedal is configured and arranged to move the shaft. A lower cymbal is mounted to the hi-hat cymbal stand and an upper cymbal is mounted to the shaft. A sensor assembly is mounted to the hi-hat cymbal stand. The sensor assembly is configured and arranged to detect the position of the upper cymbal relative to the lower cymbal.

26 Claims, 7 Drawing Sheets

ELECTRONIC HI-HAT CYMBAL CONTROLLER

CROSS-REFERENCE TO RELATED APPLICATION

This patent document claims priority to earlier filed U.S. Provisional Patent Application Ser. No. 61/529,284, filed on Aug. 31, 2011, the entire contents of which are incorporated by reference herein.

BACKGROUND OF THE INVENTION

1.Technical Field

The present invention relates generally to cymbals for making music and more particularly to an electronic high-hat cymbal controller.

2. Background of the Related Art

Electronic drum sets generally consist of controllers whose look and feel emulates the instruments of an acoustic drum set and electronic sound generators which take input from these controllers and produce electronically synthesized drum set sounds.

A typical electronic drum set will include some number of "electronic cymbals", that is, controllers whose shape and design makes them suitable for emulating the playing characteristics of various acoustic cymbals.

One important cymbal type is the high-hat. An acoustic high-hat consists of two cymbals mounted in a stand with a foot pedal. The cymbals are mounted with the concave sides facing each other and the upper cymbal can be moved down and up by pressing and releasing the foot pedal. Typically, the top cymbal is struck by the performer and the resulting sound varies, depending on whether the upper cymbal is down and in contact with the lower cymbal (referred to as closed) or up and not in contact (referred to as open). Subtle effects in timbre are available to the performer with the hi-hat cymbal partially closed (nearly touching), lightly closed, closed hard and with the upper cymbals struck in such a way that it swings down and strikes the lower cymbal. In addition, the hi-hat cymbal can be made to "speak" by pressing the pedal quickly and holding it closed (often called a "tchk" or "chik") and by pressing the pedal till the cymbals touch and releasing quickly (referred to as a "foot splash" or "pedal splash").

In current practice, the electronic implementation of a high-hat cymbal controller typically takes the form of two controllers, one that emulates the upper cymbal and one that emulates the action of the foot pedal.

The upper cymbal controller is similar to the controllers for other cymbals. In the simplest form, it has a sensor, typically a piezo-electric device, which indicates how hard the cymbal has been struck. It is possible, as with other cymbals, to add additional detectors to indicate where the cymbal has been struck (bell, bow or edge). It is also possible, as with other cymbals, to add a detector that will detect a choke. On cymbals that are not a high-hat pair, this is often a membrane switch that detects the performer damping the cymbal vibration with his hand. Typically, the lower cymbal of the acoustic high-hat pair is not present in an electronic drum set.

The foot pedal controller frequently takes the form of a stand-alone foot-pedal, completely separated from the cymbal(s). This device detects how far the pedal is depressed by the performer and sends this data to the drum synthesizer.

The completely separate electronic foot pedal has a number of deficiencies. First, since the pedal does not move the upper cymbal up or down, the playing feel of the high-hat is quite different from the acoustic instrument it is meant to emulate. Second, the feel of the foot pedal itself is quite different from that of an acoustic high-hat cymbal. An acoustic high-hat cymbal has a spring, which can be emulated by a stand-alone pedal. The acoustic high-hat pedal also moves the mass of the upper cymbal and control shaft, which is not emulated by a stand-alone pedal. Furthermore, the feel of the cymbals touching and compressing is poorly emulated by the stand-alone foot pedal.

Finally, the visual presentation of the separated cymbal and stand-alone pedal pair is quite different from an acoustic high-hat.

A number of manufacturers have sought to address these deficiencies by mounting a single electronic cymbal controller on an acoustic high-hat stand. While this approach is an improvement over the stand-alone pedal, a number of deficiencies remain.

In particular, a single cymbal plays differently than two cymbals. When an acoustic high-hat is open, the upper cymbal swings freely when struck. When it closes, this swinging motion is suppressed and the resulting stiffness increases as the cymbals are further pressed together.

In addition, existing products require either a custom high-hat stand or a complete separate electronic drum set with an existing high-hat stand. For the drummer who switches between his electronic set (often a practice set) and acoustic set, this adds cost or inconvenience.

SUMMARY OF THE INVENTION

The electronic high-hat cymbal controller of the present invention solves the problems of the prior art by providing an upper cymbal and lower cymbal connected to a high-hat stand and operable with a foot pedal. A foot pedal control module detects the position of the upper cymbal relative to the foot pedal control cymbal and generates and transmits a control signal proportional to the plunger position to a drum synthesizer.

Among the objects of the electronic high-hat cymbal controller of the present invention is the provision for an electronic high-hat cymbal controller that includes two cymbals, emulating the behavior of an acoustic high-hat cymbal.

Another object of the present invention is an electronic high-hat cymbal controller that mounts the cymbals and the pedal controller onto existing acoustic high-hat cymbal stands.

Yet another object of the present invention is an electronic high-hat cymbal controller that has long life-expectancy.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENTS

Figure 1:
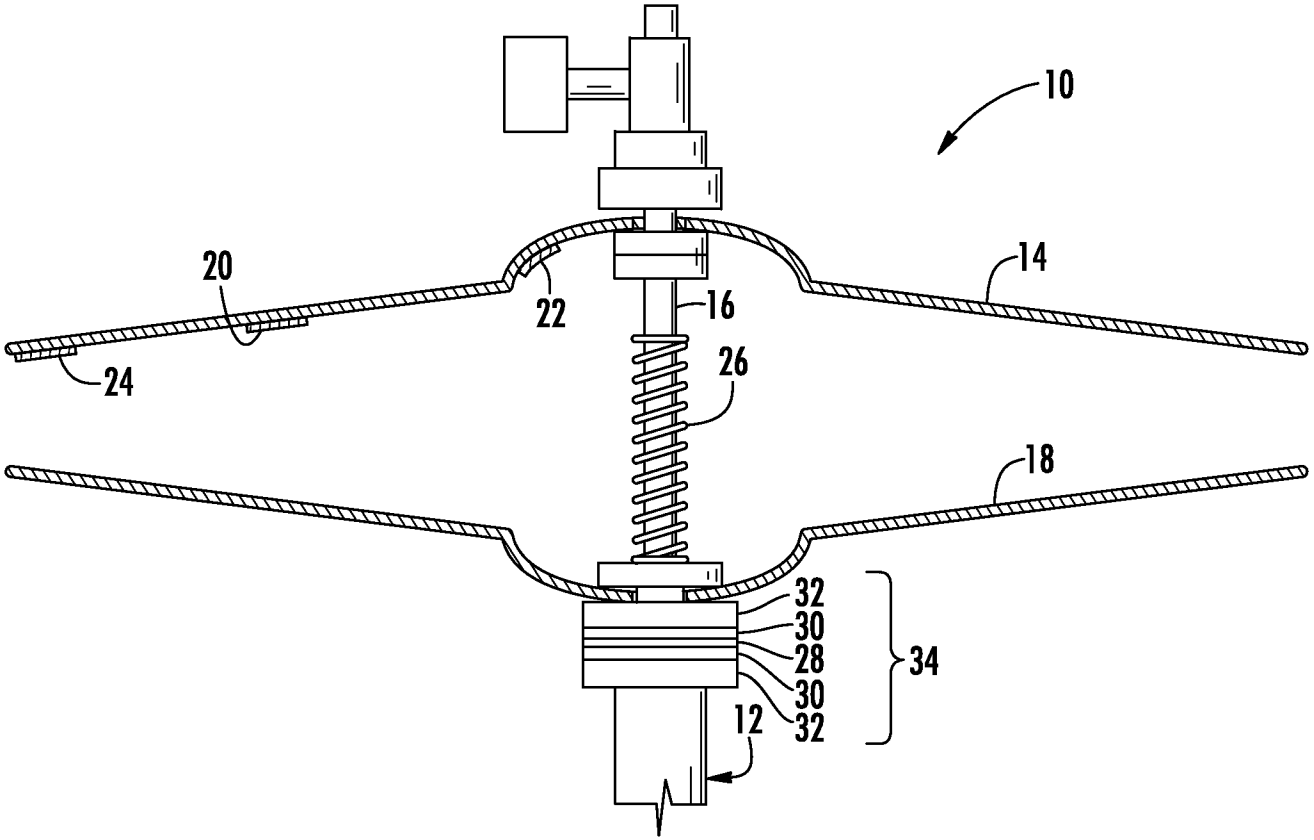
FIG. 1 is a side schematic view of a first embodiment the electronic hi-hat cymbal controller.

Referring now to FIG. 1, a preferred embodiment of the electronic hi-hat cymbal controller is shown generally at 10. The controller 10 includes a hi-hat cymbal stand 12 with an upper cymbal 14 attached to the movable shaft 16 of the hi-hat cymbal stand 12 and a lower cymbal 18 supported on the hi-hat cymbal stand 12. A foot pedal (not shown) is mechanically connected to the shaft 16 of the hi-hat cymbal stand 12 and is configured to lift the shaft 16 upwards when stepped on, as is known in the art.

The upper cymbal 14 may include additional sensors on it to detect various strikes. For instance, the upper cymbal may 14 include a strike sensor 20, such as a piezo sensor, that will detect a strike anywhere on the cymbal and return a value proportional to the velocity of the strike. The upper cymbal 14 may also include bell strike sensor 22 and edge strike sensor 24. Edge strike sensors 24 may also be used to detect a choke operation (i.e. silencing the cymbal), and the condition of the upper cymbal 14 and lower cymbal 18 touching. The sensors 20, 22, 24 may be force sensing resistors ("FSR"), piezo sensors, membrane switches and the like. The material of the upper cymbal 14 may be plastic or metal, which preferably has sound dampening material added.

The lower cymbal 18 can be plastic, metal (such as brass), other materials, and composites thereof The lower cymbal 18 is generally not configured to detect strikes, but the lower cymbal 18 may include such sensors 20, 22, 24 mentioned above for the upper cymbal 14 as desired. The lower cymbal 18 can have a hole in it to allow cables from the upper cymbal 14 and a pedal control module to be routed to the drum synthesizer module, as is known in the art. One skilled in the art would appreciate that other cable routing schemes may be used.

The upper cymbal 14 is mounted to the shaft 16 of the hi-hat cymbal stand 12.

The lower cymbal 18 is mounted to the hi-hat cymbal stand 12 in a conventional manner as an acoustic hi-hat cymbal. Cables to the sensors may be loosely fastened (with hook-and-loop cable straps or equivalent) to the hi-hat stand 12, thus limiting the rotation of the lower cymbal 18.

The controller 10 consists of two main elements. The first is a spring 26, standing between the cymbals 14, 18 on the hi-hat stand moveable shaft 16. Closing the hi-hat compresses the spring 26. When the hi-hat is fully closed, i.e. the upper cymbal 14 and lower cymbal 18 are contacting and resting on one another, the spring 26 is roughly half-compressed. Preferably, an inch or so of upper cymbal 14 "travel" on the hi-hat cymbal shaft 16 should generate a roughly linear increase in spring pressure.

Figure 2:
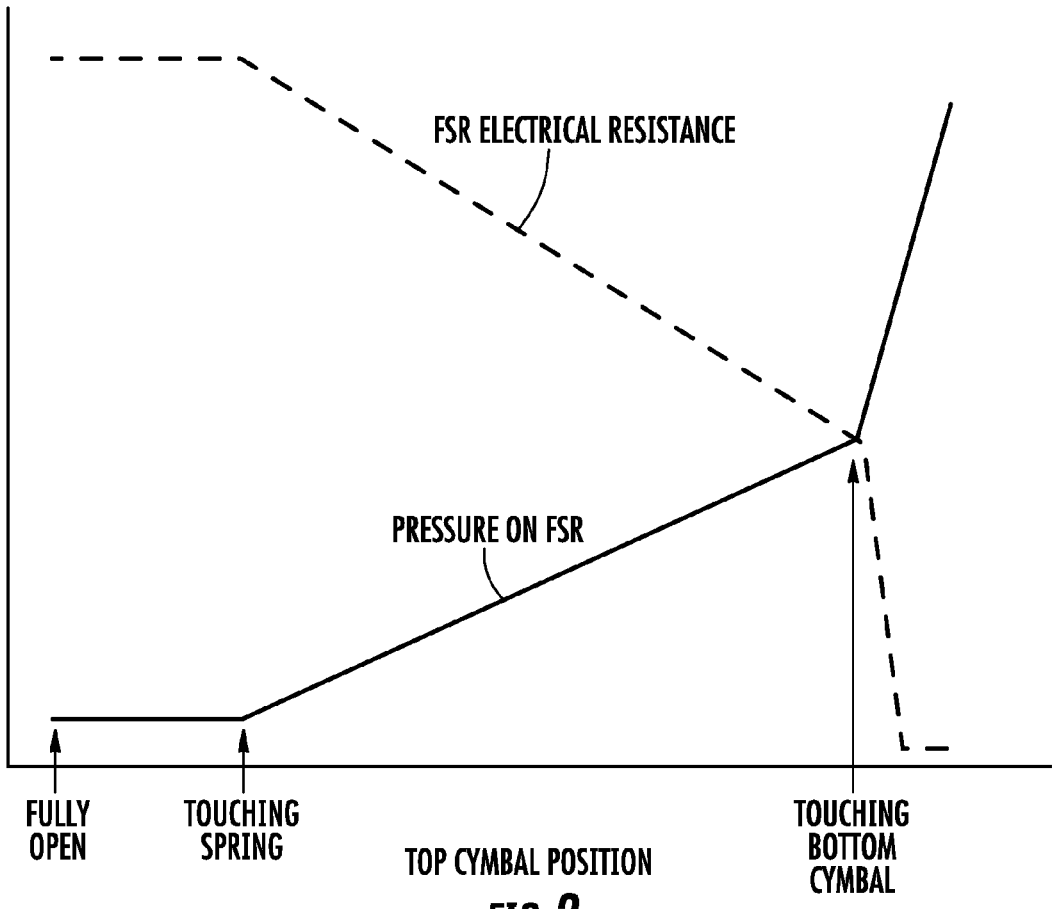
FIG. 2 is a graph of electrically resistance of the force sensing resistor versus the pressure applied on the force sensing resistor via the spring on the electronic cymbal controller.

A ring-shaped FSR 28 sits underneath the lower cymbal 18. The FSR 28 exhibits decreasing electrical resistance with increasing pressure as shown in the graph of FIG. 2. The resistance generated by the FSR 28 is the control signal that is routed to the hi-hat controller input of a drum synthesizer module. The optimal FSR resistance range emulates the resistance range of stand-alone hi-hat pedals that are known in the art.

In the course of open-to-closed motion, the FSR 28 will experience pressure as shown in the graph of FIG. 2. Before the upper cymbal 14 exerts force or contacts the spring 26, the force sensed by the FSR 28 is constant and primarily a function of the lower cymbal assembly weight. Other shapes of the FSR may be used other than ring shaped. Ring shaped is preferred because it wraps around the hi-hat cymbal stand 12.

Between touching the spring 26 and touching the lower cymbal 18, the pressure will increase in a roughly linear fashion due to spring compression. Because both cymbals 14, 18 are relatively rigid, when they touch, there will be a sharp increase in pressure. The sharpness of the change in pressure is primarily a function of the padding and washers enclosing the FSR 28, described further below.

Referring back to FIG. 1, the FSR 28 may be layered, forming a sensor assembly, in a sandwich of felt pad 30, metal washer 32, FSR 28, metal washer 32, felt pad 30 to protect the FSR 28, but ensure its fidelity, which comprise the sensor assembly 34. Those skilled in the art can readily use other materials of different thickness, hardness or softness, and change the arrangement of the layers. The material choice and layer thicknesses will "tune" the behavior at the touch point of the upper and lower cymbals 14, 18. Closed-to-open motion will reverse this response profile shown in FIG. 2.

Figure 3:
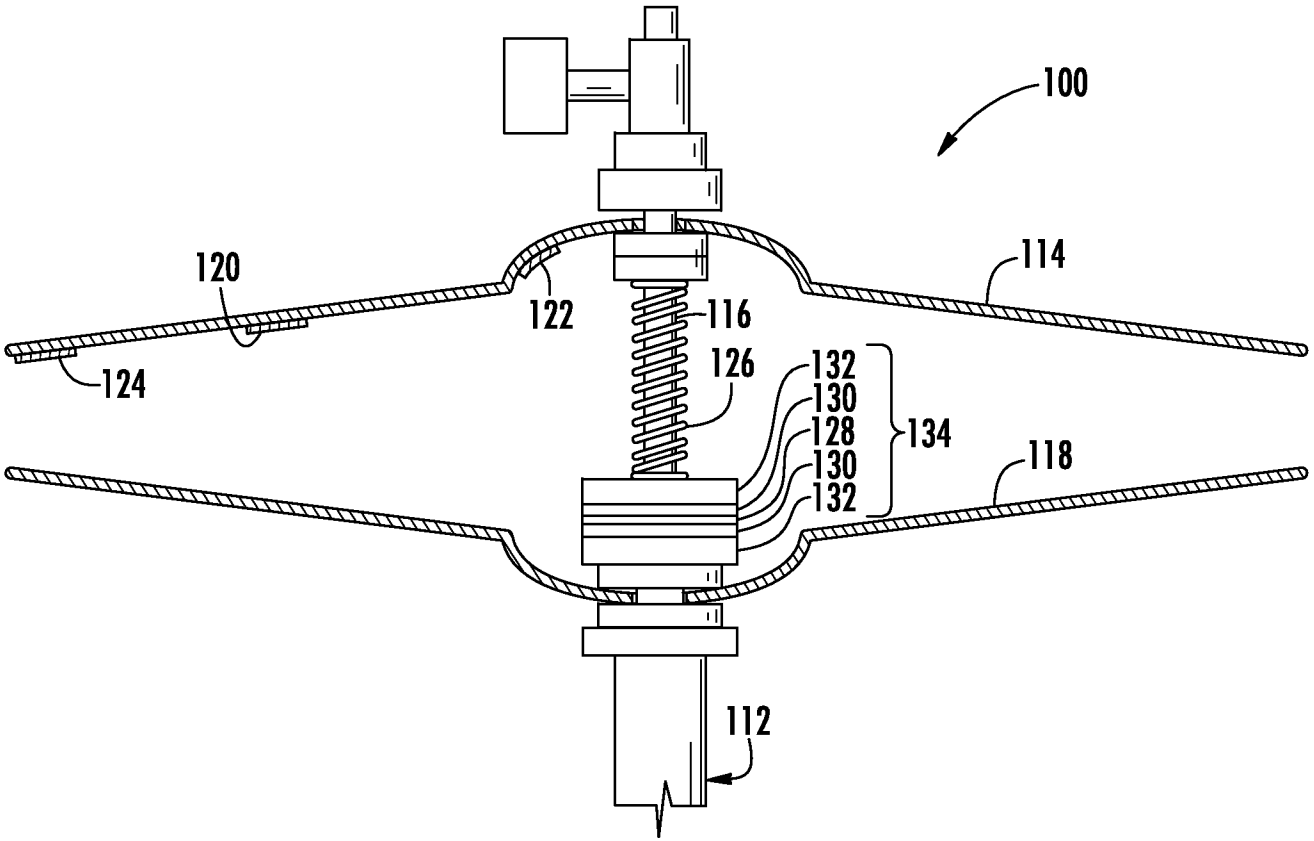
FIG. 3*is* a side schematic view of a second embodiment the electronic hi-hat cymbal controller.

In an alternate geometry shown in FIG. 3 as 100, the sensor assembly 134 may be placed on the shaft 116 above the lower cymbal 118 and below the spring 126. Like the first embodiment 10, the alternate geometry shown at 100 includes a stand 112 with a movable shaft 116. A foot pedal is included to actuate the shaft 116 as is known in the art. The upper cymbal 114 is mounted to the shaft 116 and a lower cymbal 118 is mounted to the stand 112. One or more strike 120, bell strike 122, and edge strike 124 sensors may be included on the upper cymbal 114 (and/or lower cymbal 118) as desired. Like the first embodiment 10, the alternate geometry 100 includes a sensor assembly 134 that has an FSR 128 sandwiched between a pair of hard spacers 130, which are sandwiched between a pair of soft spacers 132. The thickness and rigidity (or pliability) of the spacers 130, 132 may be varied to fine tune the sensitivity of the FSR 128.

Figure 4:
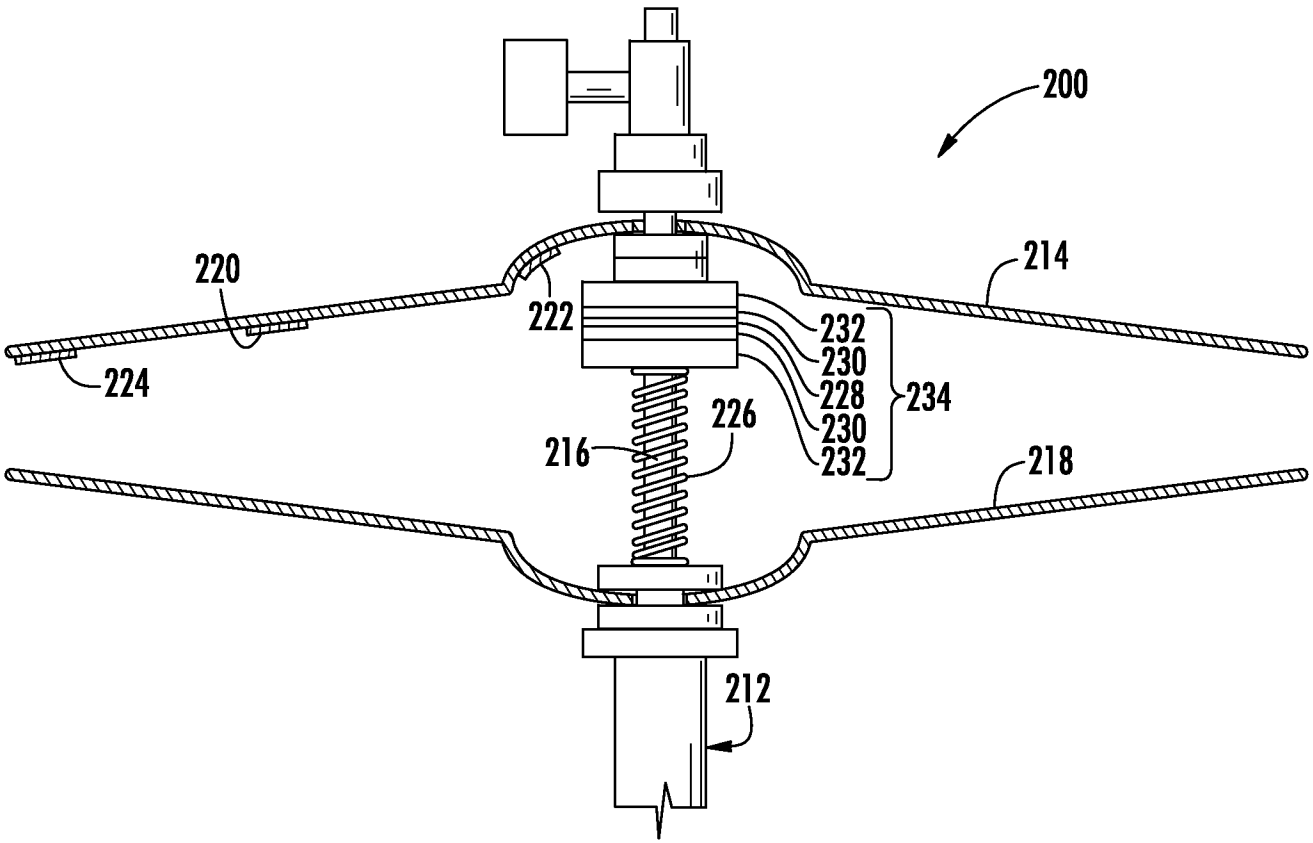
FIG. 4 is a side schematic view of a third embodiment of the electronic hi-hat cymbal controller.

Similarly, in another embodiment 200 shown in FIG. 4, the sensor assembly 234 may be placed on the shaft 216 above the spring 226 too. Like the first embodiment 10, the alternate embodiment shown at 200 includes a stand 212 with a movable shaft 216. A foot pedal is included to actuate the shaft 216 as is known in the art. The upper cymbal 214 is mounted to the shaft 216 and a lower cymbal 218 is mounted to the stand 212. One or more strike 220, bell strike 222, and edge strike 224 sensors may be included on the upper cymbal 214 (and/or lower cymbal 218) as desired. Like the first embodiment 10, the alternate embodiment 200 includes a sensor assembly 234 that has an FSR 228 sandwiched between a pair of hard spacers 230, which are sandwiched between a pair of soft spacers 232. The thickness and rigidity (or pliability) of the spacers 230, 232 may be varied to fine tune the sensitivity of the FSR 228.

As long as the sensor assembly is positioned such that the force of the compression of the spring 26, 126, 226 by the upper cymbal 14, 114, 214 can be measured, the sensor assembly 26, 126, 226 may be positioned as desired.

Figure 4A:
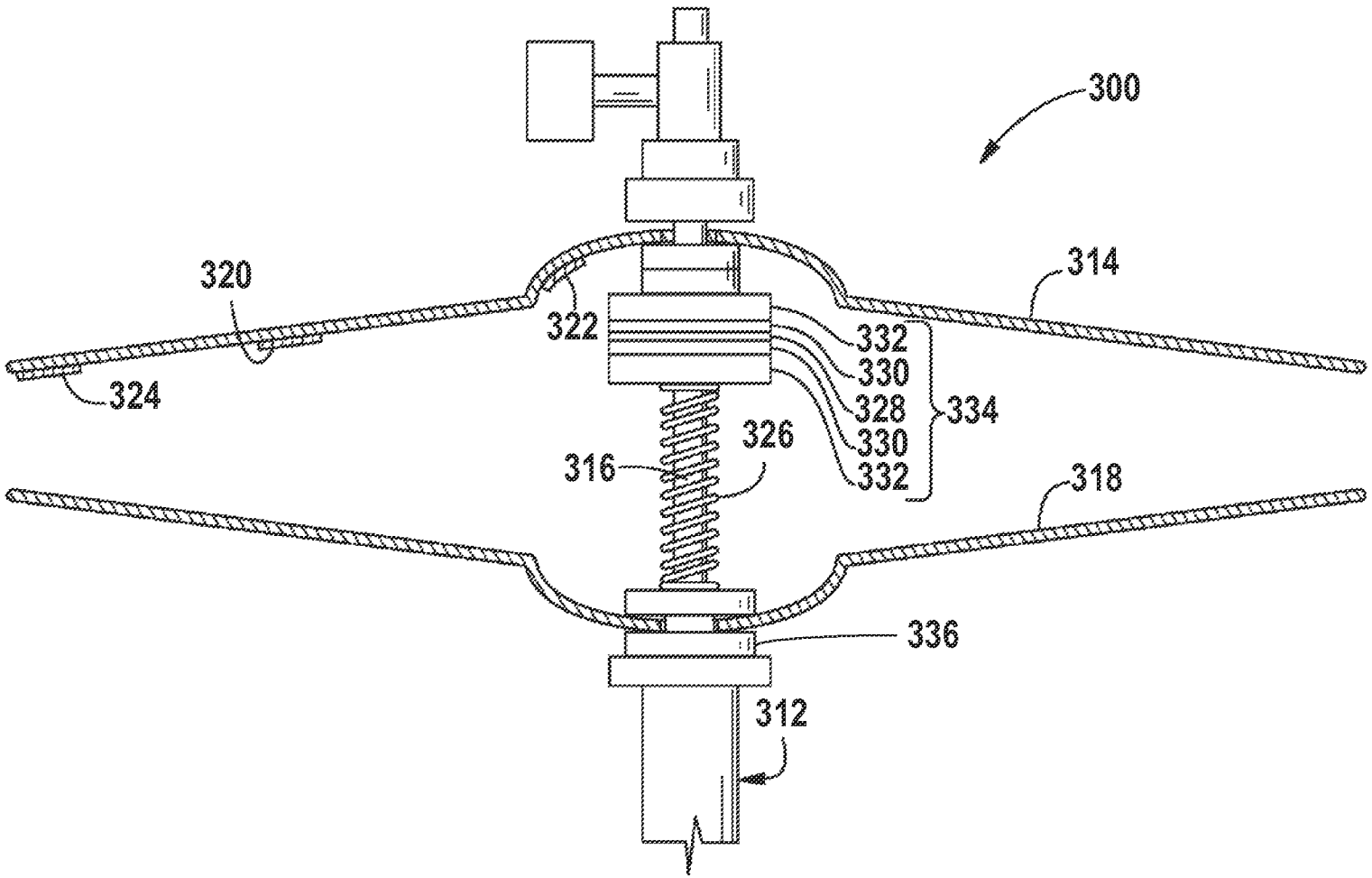
FIG. 4A is a side schematic view of a fourth embodiment of the electronic hi-hat cymbal controller.

Referring to FIG. 4A, another embodiment is shown generally at 300. A membrane switch 336 may also be added under the lower cymbal 318. The FSR 328 and membrane switch 336 would be electrically connected in parallel. In this manner, the FSR 328 will vary as described above and shown in FIG. 2, but when the membrane switch 336 closes due to the cymbals touching 314, 318, the controller 300 resistance signal will immediately go to zero ohms. Alternatively, as mentioned earlier above, the membrane switch 336 may also be placed on the edge of either cymbal 314, 318 too. In this manner, the condition of the two cymbals 314, 318 of the hi-hat cymbal controller 300 touching is clearly delineated for the drum synthesizer module.

Like the first embodiment 10, the alternate embodiment shown at 300 includes a stand 312 with a movable shaft 316. A foot pedal is included to actuate the shaft 316 as is known in the art. The upper cymbal 314 is mounted to the shaft 316 and a lower cymbal 318 is mounted to the stand 312. One or more strike 320, bell strike 322, and edge strike 324 sensors may be included on the upper cymbal 314 (and/or lower cymbal 318) as desired. Like the first embodiment 10, the alternate embodiment 300 includes a sensor assembly 334 that has an FSR 328 sandwiched between a pair of hard spacers 330, which are sandwiched between a pair of soft spacers 332. The thickness and rigidity (or pliability) of the spacers 330, 332 may be varied to fine tune the sensitivity of the FSR 328.

Figure 5:
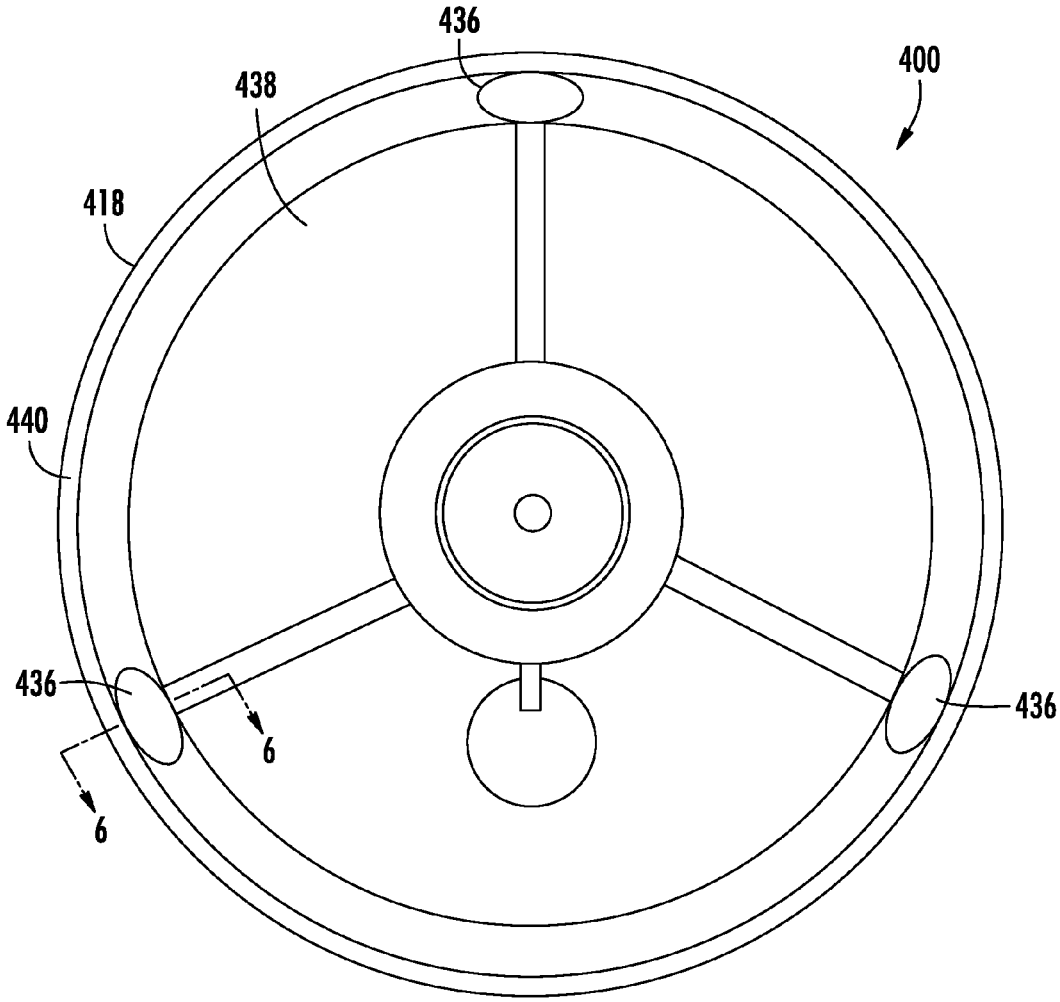
FIG. 5 is a bottom view of a lower cymbal for a fifth embodiment that includes a circuit to prevent an inadvertent "choke" of the cymbal.
Figure 6:
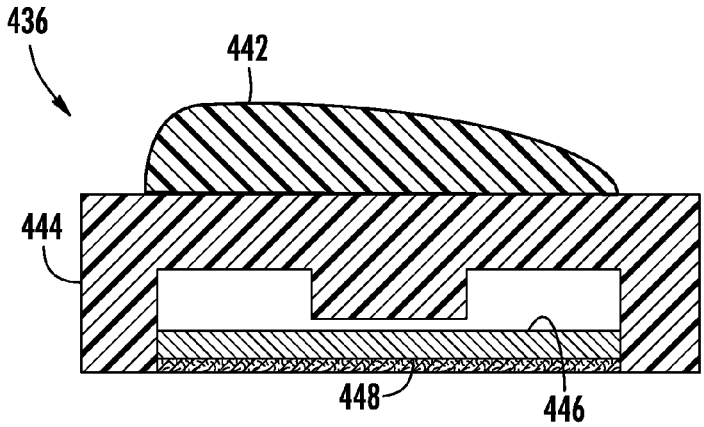
FIG. 6 is a side cross-section view through line 6-6 of FIGS. 5.
Figure 7:
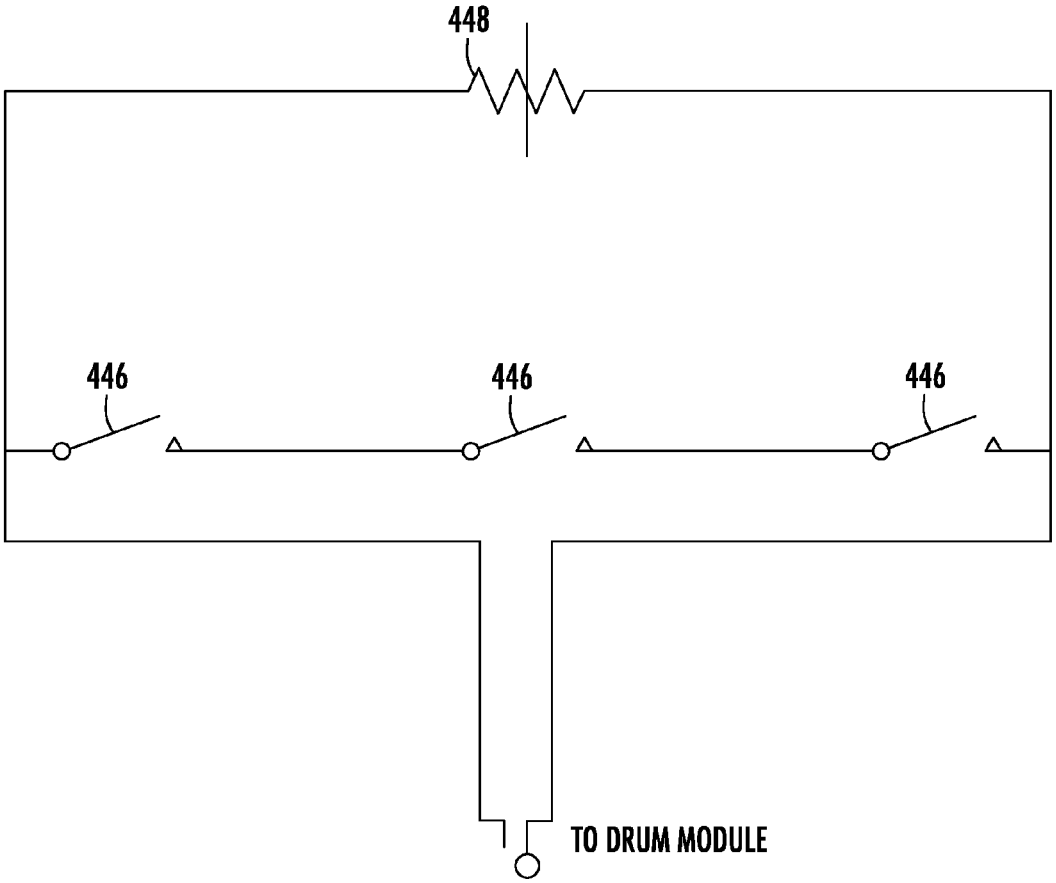
FIG. 7 is a circuit diagram showing of the fifth embodiment.

Referring not to FIG. 5-7, an embodiment is shown generally at 400. In order to prevent false closure readings a circuit may be added to the lower cymbal 418. It is common for drummers to play the high hat and stand in such a way that the upper and lower cymbals are quite close to each other. The terms often used are "half-closed" or "barely open". When the cymbals are positioned in this manner, it is common for the two cymbals to strike each other when the drummer strikes the top cymbal.

When the upper cymbal strikes the lower cymbal, there is a brief increase in pressure at the FSR 18, 128, 228, 328. This pressure can be erroneously interpreted by the drum module as a "closed" high hat pair, which causes a "choke" of the open or half-open cymbal sound. This artifact is quite unlike acoustic high hat set ups and is unacceptable.

This artifact can be eliminated in the following manner as shown in FIGS. 5-7 and described below.

A number of sensors 436 are attached to the outer upper surface 438 of the lower cymbal 418. These sensors 436 are positioned such that all sensors 418 will be actuated whenever the upper cymbal 14, 114, 214, 314 presses uniformly on the lower cymbal 418. In this embodiment, three sensors 436 are placed equidistantly around the rim 440 of the low cymbal 418. In this embodiment, membrane switches are used. Other momentary contact switches can be used and those skilled in the art will readily imagine alternate configurations and numbers of sensors 418. Each sensor 436 includes a switch actuator 442 that is configured to press down on a switch cover 444. A membrane switch 446 is located underneath the switch cover 444 and is supported by an optional layer of felt 448, which can improve sensitivity of the membrane switch 446. When the top cymbal 14, 114, 214, 314 presses down on the switch actuators 442 and switch covers 444, which are made of rubber, or a rubber-like material, in this embodiment, the membrane switches 446 close.

Referring to FIG. 7, the membrane switches 446 are added in parallel to the FSR circuit 448 (see also, 28, 128, 228, 328).When the membrane switches 446 are closed, the resistance presented to the drum module goes to nearly zero, regardless of the FSR resistance. However, since the membrane switches 446 are in series to each other, this only happens if all the membrane switches 446 are closed simultaneously.

The condition of all membrane switches 446 being closed will occur when the high hat stand pedal is depressed sufficiently to bring the upper and lower cymbals into contact. However, since the membrane switches 446 are distributed around the rim 440 of the lower cymbal 418, cymbals that strike each other from a "half-open" position cannot close all the membrane switches 446.

The system is the calibrated in such a way that the drum module does not interpret a resistance value as "closed" unless it is the value presented by the closed switches. In this way, only a closure achieved by pressing the high hat controller pedal will be interpreted as a closure event.

Note that several variants of the described embodiment are readily contrived. For instance, a variety of switch types could be used. As an example, multiple FSR elements, positioned as the membrane switches 446 can also work. The sensors 436 can be similarly attached to the top cymbal 14, 114, 214, 314, instead. With the sensors 436 added, the FSR may be integrated inside the cymbals, rather than below the lower cymbal.

As can be readily seen, this method can be used to improve the reliability of any system the uses resistance to detect the vertical position of the top cymbal.

Therefore, it can be seen that the present invention provides a unique solution to the problem of providing a high-hat cymbal controller system that is cost effective, convenient and that emulates as closely as possible the playing feel and response of acoustic high-hat cymbals.

It would be appreciated by those skilled in the art that various changes and modifications can be made to the illustrated embodiments without departing from the spirit of the present invention. All such modifications and changes are intended to be within the scope of the present invention.

What is claimed:

1. An electronic hi-hat cymbal controller, comprising:

a hi-hat cymbal stand having a pedal and a shaft, the pedal configured to move the shaft;

a lower cymbal mounted to the hi-hat cymbal stand;

an upper cymbal mounted to the shaft;

a sensor assembly mounted to the hi-hat cymbal stand, the sensor assembly configured to detect the position of the upper cymbal relative to the lower cymbal; and a false closure circuit added to the lower cymbal and connected to the sensor assembly.

2. The electronic hi-hat cymbal controller of claim 1, wherein the sensor assembly is mounted beneath the lower cymbal.

3. The electronic hi-hat cymbal controller of claim 1, wherein the sensor assembly comprises a force sensing resistor.

4. The electronic hi-hat cymbal controller of claim 1, wherein the sensor assembly comprises a membrane switch.

5. The electronic hi-hat cymbal controller of claim 1, further comprising a spring mounted to the shaft between the upper cymbal and the lower cymbal.

6. The electronic hi-hat cymbal controller of claim 1, wherein the sensor assembly comprises, a force sensing resistor sandwiched between a pair of hard spacers further sandwiched between a pair of soft spacers.

7. The electronic hi-hat cymbal controller of claim 6, wherein the hard spacers are metal washers.

8. The electronic hi-hat cymbal controller of claim 6, wherein the soft spacers are felt pads.

9. The electronic hi-hat cymbal controller of claim 1, further comprising a strike sensor mounted on the upper cymbal.

10. The electronic hi-hat cymbal controller of claim 1, further comprising a bell strike sensor mounted on the upper cymbal.

11. The electronic hi-hat cymbal controller of claim 1, further comprising an edge strike sensor mounted on the upper cymbal.

12. The electronic hi-hat cymbal controller of claim 1, wherein the sensor assembly is ring-shape.

13. The electronic hi-hat cymbal controller of claim 1, wherein the false closure circuit comprises a plurality of sensors arrayed around the rim of the lower cymbal.

14. The electronic hi-hat cymbal controller of claim 13, wherein the plurality of sensors are electrically connected in series together and the series is electrically connected in parallel with the sensor assembly.

15. An electronic hi-hat cymbal controller, comprising:

a hi-hat cymbal stand having a pedal and a shaft, the pedal configured to move the shaft;

a lower cymbal mounted to the hi-hat cymbal stand;

an upper cymbal mounted to the shaft;

a spring mounted to the shaft between the upper cymbal and the lower cymbal, the spring configured to be compressed by the upper cymbal;

a sensor assembly mounted to the hi-hat cymbal stand, and configured to detect the position of the upper cymbal relative to the lower cymbal by measuring the force exerted by the upper cymbal against the spring; and a false closure circuit added to the lower cymbal and connected to the sensor assembly.

16. The electronic hi-hat cymbal controller of claim 15, wherein the sensor assembly is mounted beneath the lower cymbal.

17. The electronic hi-hat cymbal controller of claim 15, wherein the sensor assembly comprises a force sensing resistor.

18. The electronic hi-hat cymbal controller of claim 15, wherein the sensor assembly comprises a membrane switch.

19. The electronic hi-hat cymbal controller of claim 15, wherein the sensor assembly comprises, a force sensing resistor sandwiched between a pair of hard spacers further sandwiched between a pair of soft spacers.

20. The electronic hi-hat cymbal controller of claim 19, wherein the hard spacers are metal washers.

21. The electronic hi-hat cymbal controller of claim 19, wherein the soft spacers are felt pads.

22. The electronic hi-hat cymbal controller of claim 15, further comprising a strike sensor mounted on the upper cymbal.

23. The electronic hi-hat cymbal controller of claim 15, further comprising a bell strike sensor mounted on the upper cymbal.

24. The electronic hi-hat cymbal controller of claim 15, further comprising an edge strike sensor mounted on the upper cymbal.

25. The electronic hi-hat cymbal controller of claim 15, wherein the false closure circuit comprises a plurality of sensors arrayed around the rim of the lower cymbal.

26. The electronic hi-hat cymbal controller of claim 25, wherein the plurality of sensors are electrically connected in series together and the series is electrically connected in parallel with the sensor assembly.

* * * * *